US008037887B2

(12) United States Patent
Lin

(10) Patent No.: US 8,037,887 B2
(45) Date of Patent: Oct. 18, 2011

(54) CIGARETTE-MAKING MACHINE WITH TAMPER-HOLDING MECHANISM

(75) Inventor: Mei Lin, Glenview, IL (US)

(73) Assignee: Republic Tobacco L.P., Glenview, IL (US)

( * ) Notice: Subject to any disclaimer, the term of this patent is extended or adjusted under 35 U.S.C. 154(b) by 939 days.

(21) Appl. No.: 12/018,613

(22) Filed: Jan. 23, 2008

(65) Prior Publication Data

US 2009/0183741 A1 Jul. 23, 2009

(51) Int. Cl.
*A24C 5/00* (2006.01)

(52) U.S. Cl. ..... 131/70; 131/58; 131/66.1; 131/66.2

(58) Field of Classification Search ..... None
See application file for complete search history.

(56) References Cited

U.S. PATENT DOCUMENTS

| | | | | |
|---|---|---|---|---|
| 2,551,095 | A | | 5/1951 | Chaze |
| 2,699,787 | A | | 1/1955 | Kastner |
| 2,731,971 | A | | 1/1956 | Kastner |
| 3,127,900 | A | | 4/1964 | Kastner |
| 3,688,777 | A | | 9/1972 | Kastner |
| 3,746,011 | A | | 7/1973 | Kappeler et al. |
| 3,886,952 | A | * | 6/1975 | Kastner ..... 131/70 |
| D241,354 | S | | 9/1976 | Kastner |
| D250,965 | S | | 1/1979 | Moscovitch |
| 4,249,546 | A | | 2/1981 | Heil et al. |
| 4,411,278 | A | | 10/1983 | Kastner |
| 5,088,506 | A | | 2/1992 | Kastner |
| 5,526,825 | A | | 6/1996 | Ruppert et al. |
| 5,657,768 | A | | 8/1997 | Neumann et al. |
| 6,557,560 | B2 | | 5/2003 | Kastner |

FOREIGN PATENT DOCUMENTS

| | | |
|---|---|---|
| EP | 1604576 A2 | 12/2005 |
| WO | WO 2006/130367 A2 | 12/2006 |

* cited by examiner

*Primary Examiner* — Richard Crispino
*Assistant Examiner* — Phu Nguyen
(74) *Attorney, Agent, or Firm* — Drinker Biddle & Reath LLP

(57) ABSTRACT

A cigarette-making machine of the tobacco-injecting type is provided that includes a tamper-holding mechanism. In one aspect, the tamper-holding mechanism provides for positively holding the tamper in its fully-retracted position. The tamper-holding mechanism includes a tamper-engaging member with a tamper-engaging portion and a bias. The side of the tamper includes a shoulder or projection that releasably interference couples with the tamper-engaging portion. In a first embodiment, the tamper-holding mechanism includes a tamper-engaging portion with a generally triangular-shaped body having a vertex that is urged against the side to releasably interference couple with the shoulder or projection on the side of the tamper. In another embodiment, the tamper-holding mechanism includes a tamper-engaging portion with a generally pentagonal-shaped body which is retained by a generally square U-shaped or C-shaped retaining portion that biases a vertex of the tamper-engaging portion to contact the side of the tamper.

9 Claims, 5 Drawing Sheets

CIGARETTE-MAKING MACHINE WITH TAMPER-HOLDING MECHANISM

FIELD OF THE INVENTION

This invention pertains generally to a cigarette-making machine. More particularly, this invention pertains to an injector-type cigarette-making machine with a tamper-holding mechanism.

BACKGROUND OF THE INVENTION

Injector-type cigarette-making machines are well known. As described and shown in U.S. Pat. No. 2,731,971, to Kastner for "Cigarette Making Machine," issued Jan. 24, 1956, such machines compress a portion of loose tobacco equivalent to one cigarette and then inject the compressed tobacco portion into a pre-formed cigarette tube. As is known, conventional injector-type cigarette-making machines include a crank arm which the user moves to operate the machine (i.e., compressing the loose tobacco and subsequently injecting the compressed loose tobacco), a tobacco chamber into which the loose tobacco is inserted, and a tobacco-compressing member (also known in the art as the tamper or cutter, hereinafter referred to as the tamper) which is coupled to the crank arm for translating movement in the tobacco chamber which causes compression of the loose tobacco according to movement of the crank arm. The pre-formed empty cigarette tube is held by a tube clamp at an end of a hollow nipple, which is in communication with the tobacco chamber, during the compression and injection of the portion of tobacco. Once the compressed tobacco is fully injected into the pre-formed cigarette tube (i.e., by moving the compressed tobacco from the tobacco chamber, through the hollow nipple and into the tube), the tube clamp releases the filled tube from the hollow nipple so that the cigarette may be smoked or stored for later smoking.

While such conventional machines have achieved substantial commercial success, one challenge with these machines is that, oftentimes, it is difficult for a user to load the machine because the tamper cannot be maintained in its fully retracted position without user intervention. Accordingly, to load a conventional machine with loose tobacco, the user typically maintains the crank arm in its initial position with one hand while filling the tobacco-receiving chamber with the other hand. As can be appreciated, this tobacco-loading technique is inconvenient and takes additional time because the user cannot freely use both hands to load tobacco into the machine. Furthermore, when using the aforementioned technique, there is the possibility that the user could unintentionally pinch the fingers of their hand loading the machine if their other hand holding the crank arm were to accidentally move the crank arm. To this end, an injector-type cigarette-making machine with a tamper-holding mechanism that positively maintains the tamper in a fully retracted position would be an important improvement in the art.

BRIEF SUMMARY OF THE INVENTION

A cigarette-making machine of the tobacco-injecting type is provided that includes a tamper-holding mechanism. In one aspect, the tamper-holding mechanism provides an improvement of positively holding the tamper in its fully-retracted position to facilitate fast and safe loading the machine with loose tobacco. The machine includes: a housing with a top surface having an aperture; a compacting chamber within the housing, the aperture being in communication with and defining an opening of the compacting chamber; a tamper disposed in the compacting chamber, the tamper reciprocating between a forward position in which the loose tobacco is being compressed and a fully-retracted position in which the compacting chamber is fully accessible for filling with the loose tobacco; a crank arm coupled with the tamper, rotation of the crank arm between an initial position and an intermediate position causing movement of the tamper between the fully-retracted position and the forward position; a hollow nipple configured on the housing proximate the aperture, the hollow nipple being in communication with the compacting chamber; and a tamper-holding mechanism within the housing, the tamper-holding mechanism positively maintaining the tamper in the fully-retracted position when the crank arm is disposed in the initial position. In another aspect, the tamper-holding mechanism provides an improvement of facilitating positive and immediate clamping the paper tube on the hollow nipple at the instant the crank arm is moved from its initial position.

In a first embodiment, the tamper-holding mechanism includes a tamper-engaging portion having a vertex that is urged against the side of the tamper to releasably interference couple with the shoulder or projection on the side of the tamper. In another embodiment, the tamper-holding mechanism includes a tamper-engaging portion which is retained by a generally U-shaped or C-shaped retaining portion that biases a vertex of the tamper-engaging portion to contact the side of the tamper.

DETAILED DESCRIPTION

Figure 1:
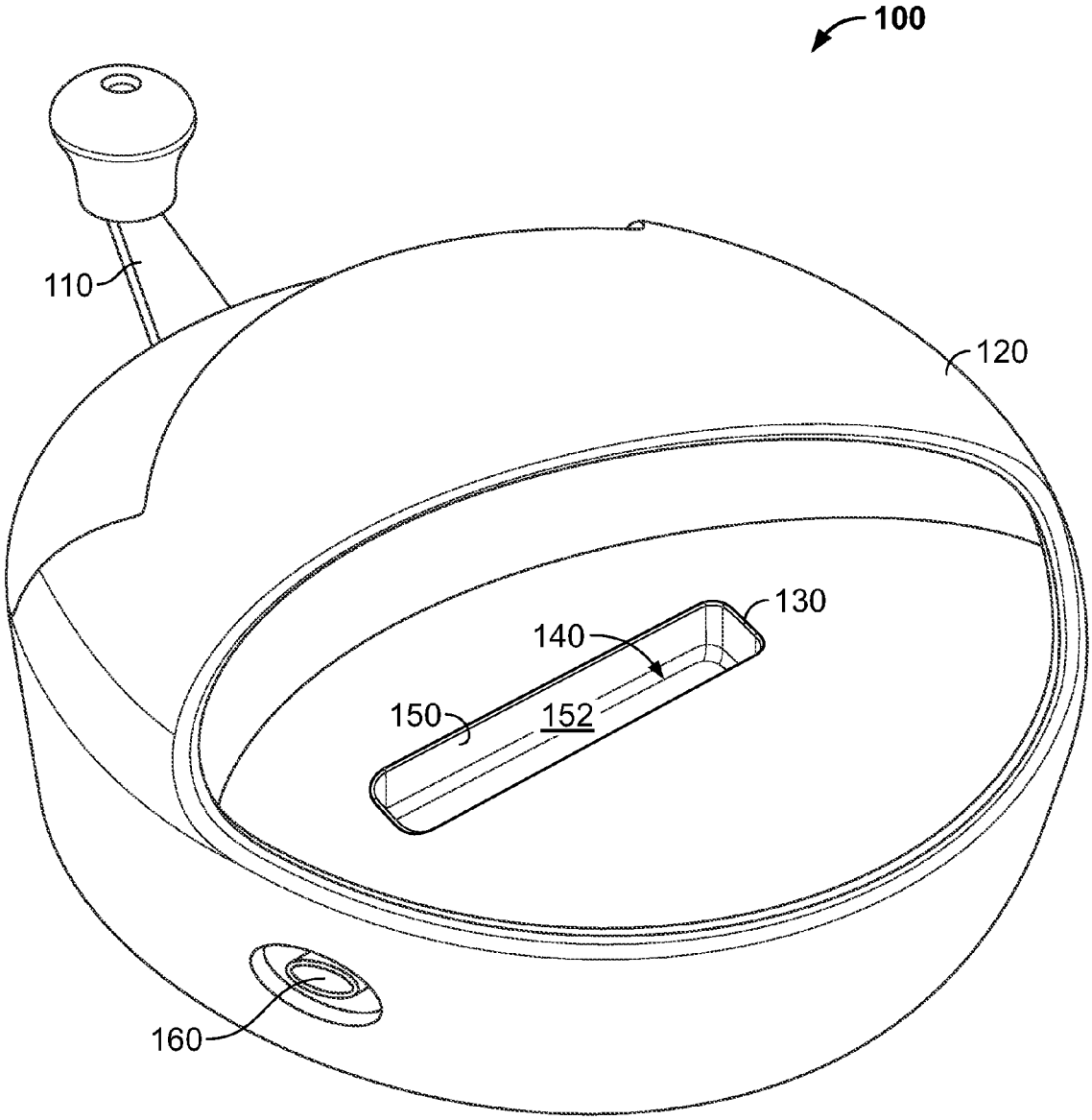
FIG. 1 shows a perspective view of an example injector-type cigarette-making machine with a tamper-holding mechanism.

Referring now to the Figures, an injector-type cigarette-making machine with a tamper-holding mechanism is provided. As shown in FIG. 1, one example embodiment of the cigarette-making machine 100 is of the injector-type where a portion of loose tobacco for a single cigarette is compacted within a compacting chamber and is then injected into a preformed paper cigarette tube. The machine 100 includes a crank arm 110 that a user moves to operate the machine 100. As known in the art, by moving the crank arm 110 from an initial (i.e., tobacco-loading) position to an intermediate position, the portion of loose tobacco is compressed. Furthermore, by moving the crank arm 110 from the intermediate (i.e., tobacco-compressing) position to a final position, the compressed portion of loose tobacco is injected into the preformed paper cigarette tube.

As shown, the illustrated embodiment of the machine 100 includes a generally circular-shaped housing 120 with an upper surface and a generally annular-shaped side surface that extends between the top surface and the bottom surface of the machine 100. As such, the top surface and generally annular-shaped side surface of the housing 120 define an internal cavity for enclosing moving component parts which will be discussed hereinafter. The housing 120 may be made of any suitable material such as metal, plastic, etc. Indeed, although the illustrated embodiment 100 has a generally circular-shaped housing 120, the machine could be configured otherwise, for example, to have a generally parallelepiped-shaped housing, etc. Although not shown, the machine 100 may include a base defining a bottom surface of the housing 120. The base may be removably attached to a lower portion of the housing 120 or bosses on a support member (170 FIG. 2) for the purpose of providing access to the moving component parts to facilitate cleaning, maintenance, repair, etc. The base may be made of any suitable material, but it is preferred that the base be a non-skid material such as rubber or the like to minimize movement (e.g., sliding) of the machine 100 on a surface during use.

As further shown in FIG. 1, the top surface of the housing 120 includes an aperture 130 that defines an opening into the compacting chamber 140, into which the loose tobacco is inserted and subsequently compressed. A generally plate-shaped tamper 150 with a concave face 152 is disposed in the compacting chamber 140 for compressing the inserted loose tobacco into a generally cylindrical-shaped tobacco member. A hollow nipple 160 is configured to at least partially project through the generally annular-shaped side wall of the housing 120 proximate to the aperture 130. The hollow nipple 160 is in communication with the compacting chamber 140 so that a hollow paper cigarette tube that is placed on the hollow nipple 160 can receive the generally cylindrical-shaped compressed tobacco member. As will be discussed hereinafter, a tube clamp (180 FIG. 2) holds the paper tube on the hollow nipple 160 during compression and injection of the tobacco.

The tamper 150 reciprocates in the compacting chamber 140 between a fully-retracted position and a compacting position relative to movement of the crank arm 110. In more detail, when the crank arm 110 is in the initial position (as shown in FIG. 1), the tamper 150 is in the fully-retracted (i.e., translated rearward) position to permit loading of the compacting chamber 140 with tobacco. As the crank arm 110 is moved from the initial position to an intermediate position, the tamper 150 moves forward to compress the inserted loose tobacco against a stationary concave wall in the compacting chamber 140. Next, as the crank arm 110 is moved from the intermediate position to a final position, the tamper 150 remains generally stationary and an injector translates through the compacting chamber 140 and hollow nipple 160 to inject the compressed tobacco into the paper cigarette tube being held on the nipple 160. By moving the crank arm 110 from the final position through the intermediate position and to the initial position, the injector is retracted into the internal cavity so that the completed cigarette may be removed from the hollow nipple 160, and the tamper 150 is translated rearward to ready the machine 100 for making another cigarette.

Figure 2:
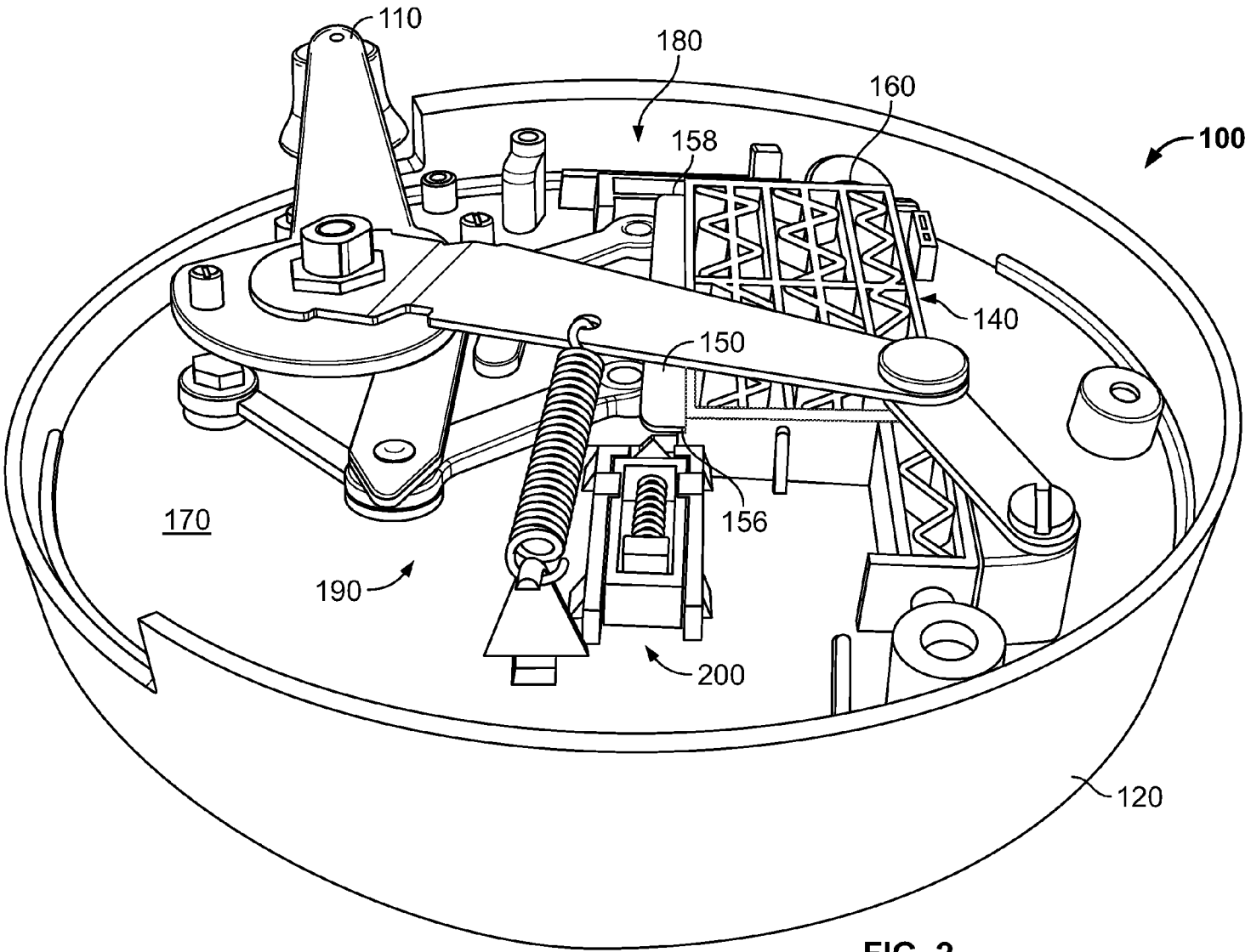
FIG. 2 shows an internal view of the machine of FIG. 1.

Turning now to FIG. 2, which shows internal components, the machine 100 is further described. As shown in FIG. 2, the machine 100 includes a support member 170 on which the various internal components (elements labeled in FIG. 2 as 140, 150, 160, 170, 180, 190, 200) are mounted, coupled, attached, connected or formed integrally therewith. The internal driving components 190 that couple the crank arm 110 to the tamper 150 for reciprocal movement and which effect injection of the compressed tobacco into the paper tube are well known and, therefore, are not discussed for brevity. Accordingly, portions of the aforementioned U.S. Pat. No. 2,731,971, to Kastner for "Cigarette Making Machine," issued Jan. 24, 1956 relating to the toggle joints, links, cam, axle, arms and plunger are incorporated by reference herein. As further shown, the machine 100 includes an improvement comprising a tamper-holding mechanism. One embodiment of the tamper-holding mechanism which is shown in FIGS. 2 and 3 is labeled 200 whereas another embodiment of the tamper-holding mechanism shown in FIG. 4 (and which will be described later) is labeled 300.

As shown in FIG. 2, the tamper 150 is interposed between the tube clamp 180, which holds the paper cigarette tube on the hollow nipple 160, and the tamper-holding mechanism 200. The tamper 150 includes a first lengthwise face or side 152 (shown in FIG. 1) that is concave, a second lengthwise side 154 (best illustrated in FIG. 5) that is parallel to the first lengthwise side 152 and connected to the internal driving components 190. Furthermore, the tamper 150 includes third and fourth sides 156, 158 that are perpendicular to and extending between the first and second lengthwise sides 152, 154. As shown, side 158 of the tamper 150 is facing the tube clamp 180 whereas side 156 is facing the tamper-holding mechanism 200. As will be understood from FIGS. 3-5 and the description that follows, the tamper-holding mechanism 200, 300 positively maintains the tamper 150 in its fully retracted position to facilitate loading the tobacco chamber 140 with loose tobacco and to prevent accidental pinch injuries during the loading process.

Figure 3:
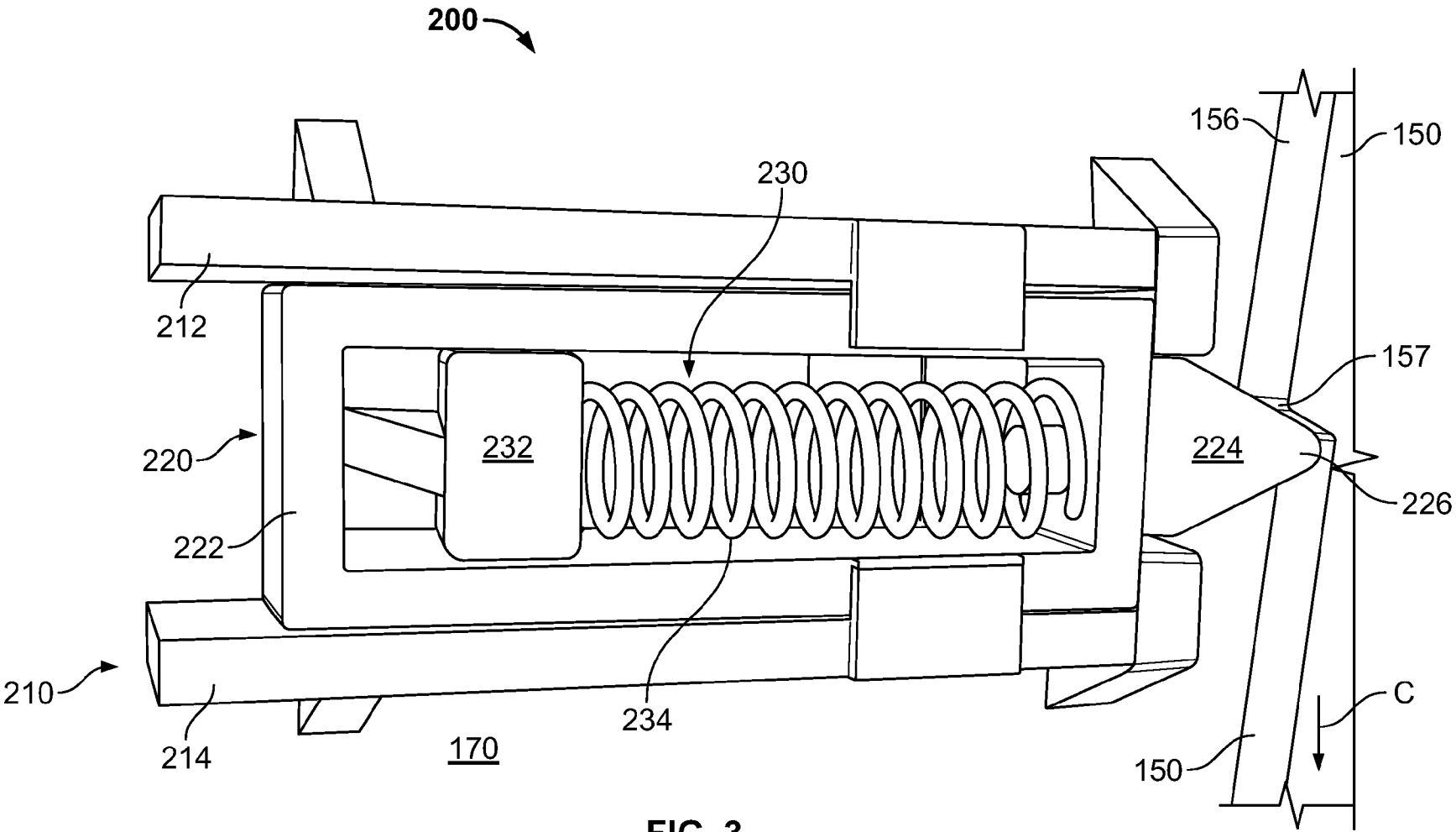
FIG. 3 shows a close-up view of an embodiment of the tamper-holding mechanism.
Figure 4:
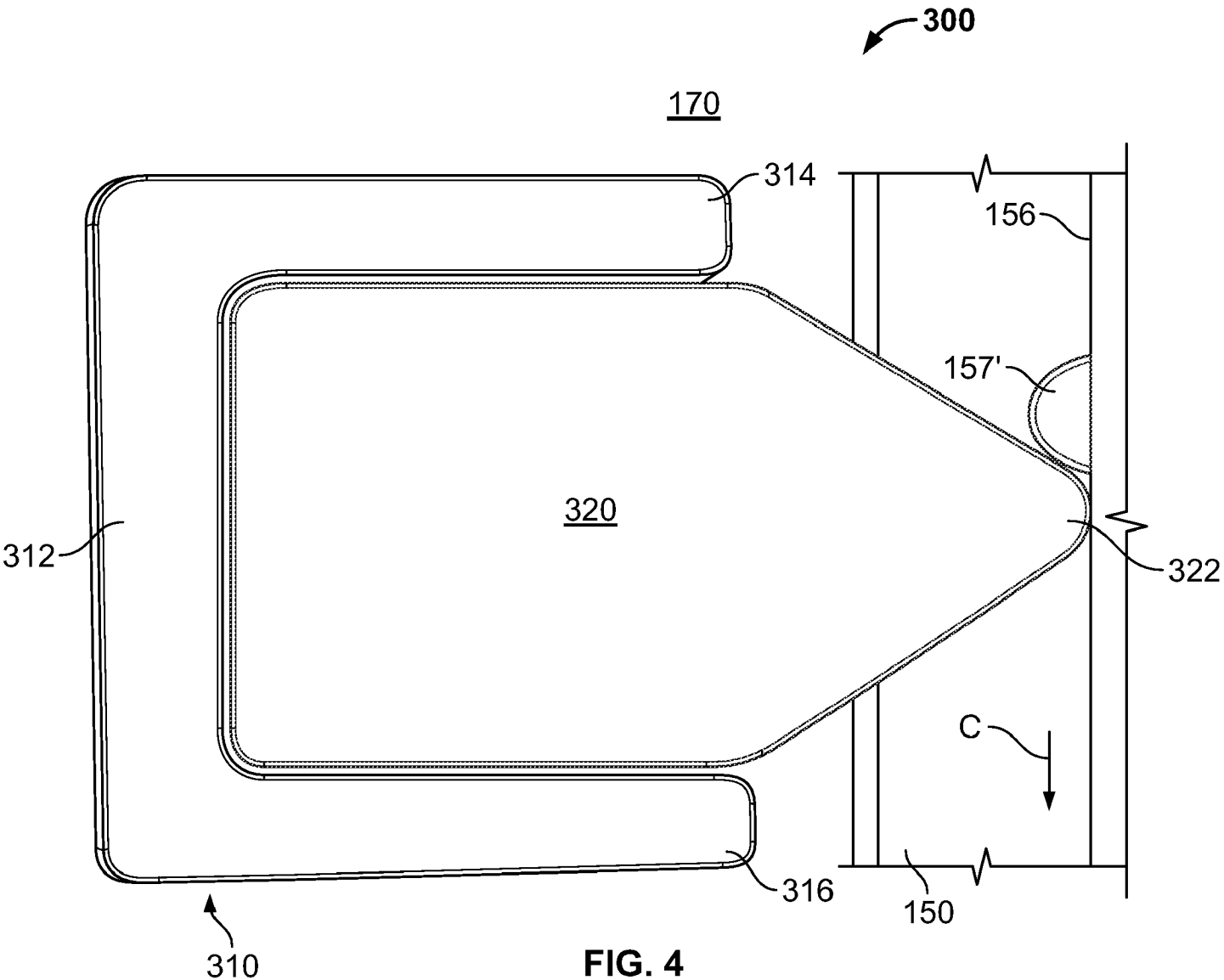
FIG. 4 shows a close-up view of another embodiment of the tamper-holding mechanism.

As shown in FIG. 3, the tamper-holding mechanism 200 includes a base portion 210 connected or integral with the support member 170. The base portion 210 includes a first retaining member 212 and a second retaining member 214 that is generally parallel with and a mirror image of the first retaining member 212. A tamper-engaging member 220 includes a generally rectangular hollow frame 222 configured between and slidably movable on the support member 170 relative to the retaining members 212, 214. A generally triangular tamper-engaging portion 224 is connected or integral with a side of the frame 222 facing the tamper 150, particularly the side 156 including shoulder 157 which alternatively may be a projection 157' (FIG. 4). The generally triangular tamper-engaging portion 224 extends between the retaining members 212, 214 past ends thereof to contact the side 156 of tamper 150. As further shown, the tamper-engaging mechanism 200 includes a bias member 230 that urges a vertex 226 of the tamper-engaging portion 224 against the side 156. In particular, the vertex 226 is configured to releasably interfere with the shoulder 157, thereby preventing the tamper 150 from moving from its fully-retracted position shown in FIG. 3 to the compacting position as is indicated by the arrow labeled "C" that represents movement of the tamper 150 to the compacting position.

The bias member 230 causes the tamper-engaging member 220 to function as a cam follower against the side 156. As such, the bias member 230, as shown, includes a bias anchor portion 232 that is generally stationary and configured within the frame 222 on (i.e., connected or integral with) the support member 170. The bias member 230 further includes a spring 234 that extends between the anchor portion 232 and the side of the frame 222 from which the tamper-engaging portion 224 extends. Although a spring 234 is shown, other elastic, elastomeric or deformable bias means with a shape memory known in the art may alternatively be used. In this way, the tamper-engaging member 220 is slidably urged along the surface of support member 170 into contact with the side 156. Accordingly, to move the tamper 150 from its fully-retracted position shown in FIG. 3 to its compacting position (as is indicated by the arrow labeled "C"), the user of the machine 100 must exert sufficient force on the crank arm 110 so that the shoulder 157 causes the tamper-engaging member 220 to move in a leftward manner (as shown) against the urging of the bias member 230. When the vertex 226 and shoulder 157 engage or disengage each other, the tamper-holding mechanism 200 may provide a sensory indication to the user such as a tactile/haptic or audible "pop," "snap" or "click." In this way, the user is provided with a positive indication that the tamper 150 is positioned and being maintained in its fully-retracted position so that it is safe to load the tobacco chamber 140.

Another embodiment 300 of the tamper-holding mechanism is shown in FIG. 4. As shown in FIG. 4, the tamper-holding mechanism 300 includes a generally stationary retaining portion 310 connected or integral with the support member 170. The retaining portion 310 has a base portion 312 and generally parallel side portions 314, 316 that extend generally perpendicularly from ends of the base portion 312. In this way, the retaining portion 310 has a generally square U-shaped or square C-shaped configuration. A tamper-engaging portion 320 includes a generally pentagonal shaped body with a vertex 322. The tamper-engaging portion 320 is configured between the generally parallel side portions 314, 316 and is slidably movable toward and away from the base portion 312. The tamper-engaging portion 320 is configured to have a length (i.e., a distance between the vertex 322 and a planar side proximate to the inner surface of the base member 312) that is substantially similar to or slightly greater than a distance between the side 156 and the inner surface of the base member 312. In this way, the retaining portion 310 and tamper-engaging portion 320 cooperate to urgingly bias the vertex 322 against the side 156. In particular, the vertex 322 is configured to releasably interfere with the projection 157', thereby preventing the tamper 150 from moving from its fully-retracted position shown in FIG. 4 to the compacting position as is indicated by the arrow labeled "C" that represents movement of the tamper 150 to the compacting position. Accordingly, to move the tamper 150 from its fully-retracted position shown in FIG. 4 to its compacting position (as is indicated by the arrow labeled "C"), the user of the machine 100 must exert sufficient force on the crank arm 110 so that the projection 157' causes the tamper-engaging member 320 to move in a leftward manner (as shown) against the base portion of the retaining portion 310. Similar to the previous embodiment, when the vertex 322 and projection 157' engage or disengage each other, the tamper-holding mechanism 300 may provide a sensory indication to the user such as a tactile/haptic or audible "pop," "snap" or "click." In this way, the user is provided with a positive indication that the tamper 150 is positioned and being maintained in its fully-retracted position so that it is safe to load the tobacco chamber 140.

As can be appreciated, the biasing of tamper-holding mechanisms 200, 300 against the tamper 150 requires a user to exert a predetermined force to the crank arm 110 to initiate movement of the tamper 150 from its fully-retracted position. In particular, the predetermined force exerted by the user on the crank arm 110 must be sufficient to overcome the interference fit between the vertex 226 or 322 and the shoulder 157 or projection 157', thereby forcing the shoulder 157 or projection 157' past the vertex 226 or 322 against the bias. Accordingly, the tamper-holding mechanisms 200, 300 prevent accidental or unintentional movement of the crank arm 110 and tamper 150 so that the tobacco chamber 140 can be quickly and safely loaded with loose tobacco.

Figure 5:
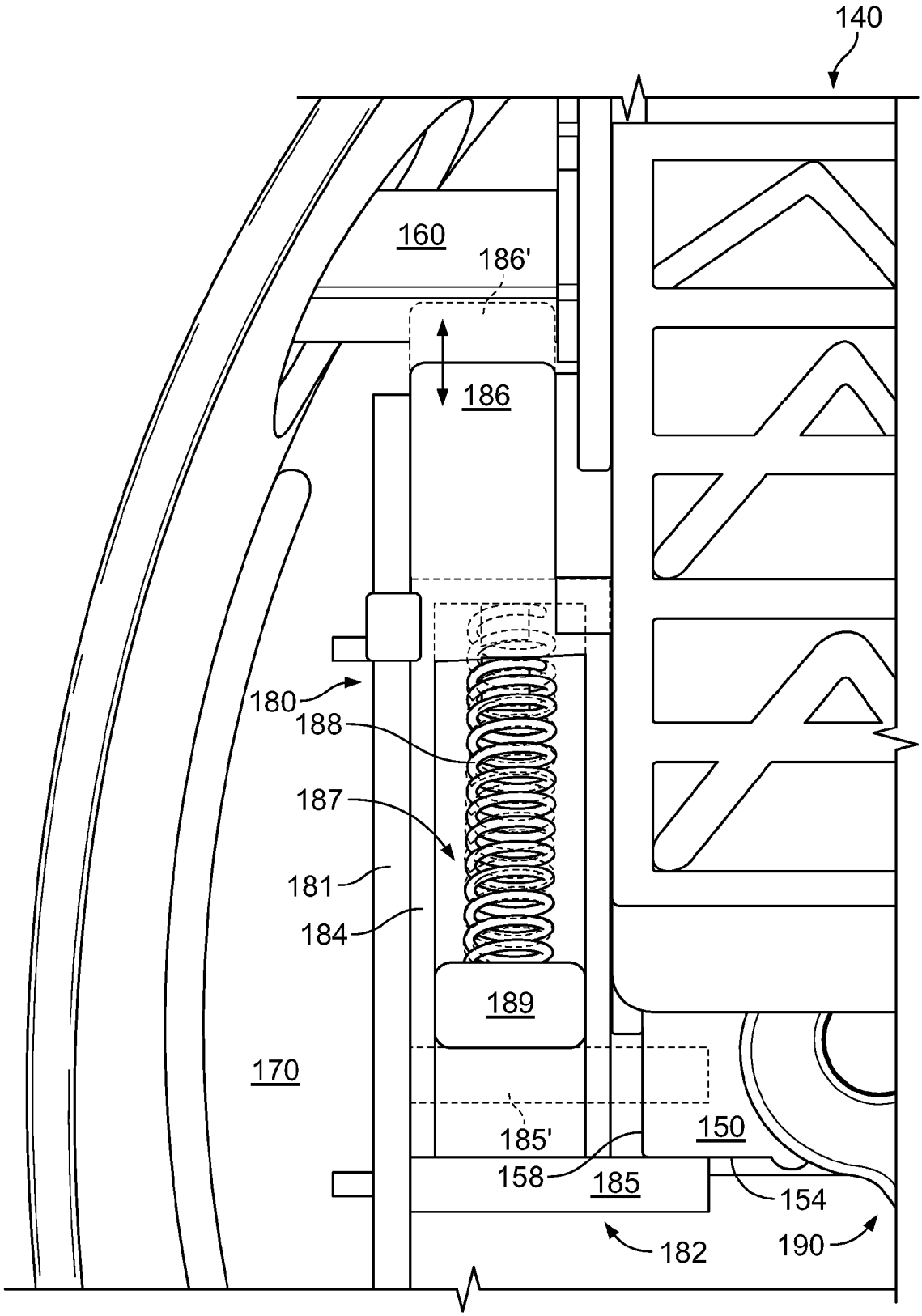
FIG. 5 shows a close-up view of a tube clamp which cooperates with the tamper-holding mechanism.

Referring now to FIG. 5, an additional feature of the machine 100 having a tamper-holding mechanism 200, 300 is described. As will be understood, because the tamper-holding mechanism 200, 300 and the tube clamp 180 both engage with the tamper 150 (particularly its sides 156 and 154 respectively), the machine 100 is provided with an additional benefit of positively and immediately clamping the paper tube on the hollow nipple 160 at the instant the crank arm 110 is moved from its initial position. As shown in FIG. 5 the tube clamp 180 includes a tube clamp base 181 that is connected or integral with the support member 170. The tube clamp base 181 as shown is generally perpendicular to the hollow nipple 160 to generally align a tube clamp member 182 with the hollow nipple 160 and facilitate back and forth reciprocal movement of the tube clamp member 182 against the hollow nipple 160. As further shown, the tube clamp member 182 includes a generally rectangular hollow frame 184 configured between the tube clamp base 181 and the compacting chamber 140 and which is slidably movable on the support member 170. A tamper-engaging projection 185 is connected or integral with a first side of the frame 184 distal from the hollow nipple 160. Furthermore, a tube-clamping portion 186 is connected or integral with a second side of the frame 184 that is opposite from the first side of the frame 184 (having the tamper-engaging projection 185) and proximate to the hollow nipple 160.

The tube clamp member 182 as shown further includes a tube clamp bias member 187. The tube clamp bias member 187 is configured within the frame 184 and includes a spring 188 and a clamp bias anchor 189 that is generally stationary and configured on (i.e., connected or integral with) the support member 170. Although a spring 188 is shown, other elastic, elastomeric or deformable bias means with a shape memory known in the art may alternatively be used. The spring 188 extends between the clamp bias anchor 189 and the side of the frame 184 from which the tube-clamping portion 186 extends. In this way, the frame 184 is spring biased to move away from the clamp bias anchor 187 so that the tube-clamping portion 186 is slidably urged against the hollow nipple 160. As shown, tube clamp bias member 187 causes the tamper-engaging projection 185 to act as a cam follower which maintains contact with the side 154 of the tamper 150.

In operation, when the crank arm 110 is moved to the initial position such that the tamper 150 is in its fully-retracted position (e.g., to allow the user to load the tobacco chamber 140 with loose tobacco), the tube clamp member 182 and the tube-clamping portion 186 are moved or cammed away from the hollow nipple 160 by the side 154 so that the spring 188 is compressed and the user can, therefore, place a paper tube on the hollow nipple 160. Furthermore, when the machine 100 is in its tamper-holding mechanism maintained loading state (i.e., the crank arm 110 being in the initial position and the tamper 150 being in the fully-retracted position), the spring 189 is released or decompressed at an instant that the crank arm 110 is moved from the initial position (i.e., by overcoming the bias of the tamper-holding mechanism 200, 300) such that the tamper-engaging projection 185 moves to the position 185' shown in phantom lines to maintain contact with the side 154. Accordingly, the tube-clamping portion 186 moves to the position 186', which is also shown in phantom lines, where the tube-clamping portion 186 is in intimate contact with the hollow nipple 160 for holding a paper tube thereon. As described and shown, the tamper-holding mechanism 200, 300, the tamper 150 and the tube clamp 180 cooperate to provide positive holding of the tamper 150 and positive clamping of the tube clamp 180.

Various embodiments of the invention are described herein. It should be understood that the illustrated embodiments are exemplary only, and should not be taken as limiting the scope of the invention.

What is claimed is:

1. A cigarette-making machine comprising:

a housing including a top surface having an aperture;

a compacting chamber within the housing for receiving the loose tobacco, the compacting chamber in communication with the aperture;

a tamper disposed in the compacting chamber and including a side having at least one of a projection or a shoulder, the tamper reciprocating between a forward position in which loose tobacco in the compacting chamber is compressed and a fully-retracted position in which an entire volume of the compacting chamber is available for filling with loose tobacco;

a crank arm coupled with the tamper, rotation of the crank arm between an initial position and an intermediate position causing movement of the tamper between the fully-retracted position and the forward position;

a hollow nipple configured on the housing, the hollow nipple in communication with the compacting chamber; and a tamper-holding mechanism within the housing including a tamper releasable interference coupling comprising one of the projection or the shoulder of the tamper and a tamper engaging member having a bias member to releasably maintain the tamper engaging member against the tamper projection or shoulder when the tamper is in the fully-retracted position to keep the tamper in the fully-retracted position until a sufficient force is applied to the tamper to move it past the tamper engaging member.

2. The cigarette-making machine of claim 1 wherein the tamper-holding mechanism provides an indication whether the tamper is secured through interaction of the tamper engaging member and the at least one of the projection or the shoulder.

3. The cigarette-making machine of claim 2 wherein the indication is at least one of a tactile indication and an audible indication.

4. The cigarette-making machine of claim 1 wherein the tamper-engaging portion has a generally triangular shape.

5. The cigarette-making machine of claim 1 wherein the bias member comprises a spring.

6. The cigarette-making machine of claim 1 wherein the bias member comprises a generally U-shaped member.

7. The cigarette-making machine of claim 6 wherein the tamper-engaging portion has a generally pentagonal shape for sliding movement in the generally U-shaped member.

8. The cigarette-making machine of claim 1 further comprising a tube clamp that holds the paper tube on the hollow nipple, the tube clamp cooperating with the tamper-holding mechanism to clamp the paper tube at an instant that the crank arm is moved from the initial position.

9. The cigarette-making machine of claim 8 wherein the tube clamp comprises:

a clamp portion that couples with the hollow nipple;

a second bias member that urges the clamp portion against the hollow nipple; and a cam portion connected to the clamp portion, the cam portion maintaining engagement with the tamper so that, in the initial position, the clamp portion is moved away from the hollow nipple against the second bias member.

* * * * *